United States Patent [19]

Toropov et al.

[11] Patent Number: 4,498,322

[45] Date of Patent: Feb. 12, 1985

[54] THREAD-ROLLING TOOL

[76] Inventors: Gennady A. Toropov, ulitsa Mironova, 17, kv. 45; Stepan P. Shamenko, prospekt Geroev, 33, korpus 1, kv. 45, both of Dnepropetrovsk, U.S.S.R.

[21] Appl. No.: 355,754

[22] PCT Filed: Jun. 30, 1980

[86] PCT No.: PCT/SU80/00117

§ 371 Date: Feb. 23, 1982

§ 102(e) Date: Feb. 23, 1982

[87] PCT Pub. No.: WO82/00109

PCT Pub. Date: Jan. 21, 1982

[51] Int. Cl.[3] ..... B21H 03/08

[52] U.S. Cl. ..... 72/118

[58] Field of Search ..... 72/103, 104, 118, 119, 72/88

[56] References Cited

U.S. PATENT DOCUMENTS

| | | | |
|---|---|---|---|
| 2,645,954 | 7/1953 | Pfingston | 72/118 |
| 3,813,718 | 6/1974 | Kamiya | 72/88 |

FOREIGN PATENT DOCUMENTS

| | | |
|---|---|---|
| 1086661 | 4/1958 | Fed. Rep. of Germany . |
| 8201084 | 2/1982 | Sweden . |
| 625824 | 9/1978 | U.S.S.R. . |

*Primary Examiner*—Lowell A. Larson

*Attorney, Agent, or Firm*—Fleit, Jacobson, Cohn & Price

[57] ABSTRACT

A thread-rolling tool having a body provided with thread rollers uniformly disposed along the circumference thereof, the axes of the rollers being in angular position relative to the axis of rotation of the body and at an angle equal to the lead angle of the helical line of the thread being rolled. The body includes groove-forming rollers having a pitch equal to that of the thread rollers and being disposed at an angle relative to the axis of rotation of the body and at an angle relative to the latter. The top portions of the thread of the groove-forming roller being disposed with an axial displacement relative to the top portions of the thread of a preceding thread roller, when viewed in the projection on a plane normal to the axis of rotation of the body 1, the amount of said displacement being:

$$(P/2)-(P\beta/360°)$$

where

P is a pitch of the thread being rolled.

$\beta$ is an angle between the axes of rotation of the groove-forming and preceding thread rollers if viewed in the projection on a plane normal to the axis of rotation of the body.

1 Claim, 2 Drawing Figures

THREAD-ROLLING TOOL

TECHNICAL FIELD

The invention relates to the manufacture of products having helically shaped elements by plastic deformation of a metal blank and can be utilized for rolling female threads of a resilient profile inside through holes.

BACKGROUND ART

Known in the art are tools for rolling female threads in which thread rollers are uniformly disposed along the circumference thereof relative to the axis of rotation of the tools and are utilized for rolling threads in plastic, steels and alloys. Such tools can be used for rolling threads of a resilient profile, though in this case only thread-rolling devices having a rigid MDTW gearing (machine-tool-device-tool-workpiece) can be utilized.

Also known in the art is a tool for rolling female threads (USSR Inventor's Certificate No. 108, 253, published Sept. 26, 1956), which tool is a body provided with a tail portion for fixing said body inside a rotating spindle of, for example, a drilling machine. Within the body there are provided thread rollers which are uniformly disposed around the circumference thereof relative to the axis of rotation of said body, the axes of the rollers being in an angular position at an angle equal to the lead angle of the helical line of the thread being rolled.

The profile of the circular grooves of the thread rollers is made in accordance with that of the thread being rolled.

When said body is caused to rotate, the thread rollers also start rotating under the action of friction forces applied against the surface of the thread being rolled, and the body starts screwing into the hole.

Such a tool can be applied in the manufacture of a female thread of a resilient profile inside a through bore, though in this case the provision of a rigid MDTW gearing is required, thus resulting in the complication of the thread-rolling devices. The presence of clearances within the gearing system affects the stability of the resilient properties of the resulting thread.

DISCLOSURE OF INVENTION

The invention is directed to the provision of a thread-rolling tool enabling rolling female threads of a resilient profile inside through bores, without application of a rigid MDTW gearing, by forming a cavity inside the profile of the resulting thread.

The object set forth is attained by the provision of a thread-rolling tool comprising a body provided with thread rollers uniformly disposed around the circumference thereof with their axes being in an angular position relative to the axis of rotation of the body, at an angle equal to the lead angle of the helical line of the thread being rolled. According to the invention, groove-forming rollers are mounted within the body, said rollers having a pitch equal to that of the thread rollers and being disposed relative to the axis of rotation of the body similar to the thread rollers, but in an angular position relative to the latter. The top portions of the thread of the groove-forming roller are disposed with axial displacement relative to the top portions of the thread of a preceding thread roller, if viewed in the projection on a plane normal to the axis of rotation of the body, the amount of said displacement being:

$$(P/2)-(P\cdot\beta/360°),$$

where

P is a pitch of the thread being rolled $\beta$ is an angle between the axes of rotation of the groove-forming and preceding thread rollers if viewed in the projection on a plane normal to the axis of rotation of the body.

The thread-rolling tool of such a design does not require the provision of additional devices ensuring a rigid MDTW gearing.

Such an arrangement excludes the influence of clearances being present within the above described rigid gearing system, on the resilient properties of the resulting thread having a resilient profile.

BRIEF DESCRIPTION OF DRAWINGS

Now the invention will be described in more detail with reference to the accompanying drawings, in which.

BEST MODE FOR CARRYING OUT THE INVENTION

Figure 1:
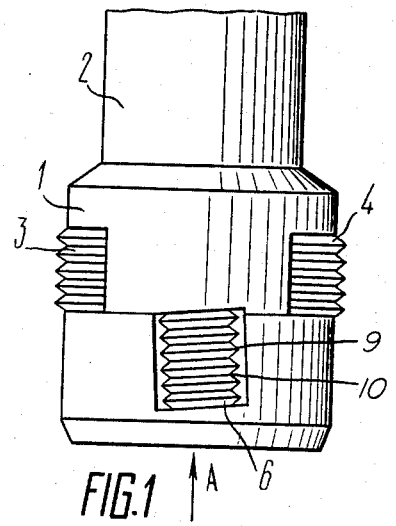
FIG. 1 is a front view of the thread-rolling tool of the invention.
Figure 2:
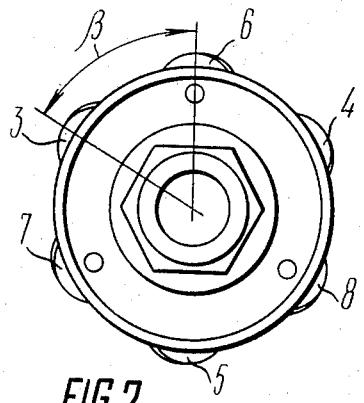
FIG. 2 is a bottom view of the thread-rolling tool of the invention.

A thread-rolling tool for rolling female threads of a resilient profile inside through holes comprises a body 1 provided with a tail portion 2 for fixing said body inside a rotating spindle of, for example, a drilling machine. The body 1 is provided with three grooves being uniformly disposed along the circumference thereof relative to the axis of rotation of the body 1, at an angle therebetween being 120°, and the axes of said grooves being in an angular position relative to the axis of rotation of the body 1 at an angle equal to the lead angle of the thread being rolled. Within said grooves there are disposed thread rollers 3, 4, 5. Within the same body 1, in front of the thread rollers 3, 4, 5, there are similarly disposed groove-forming rollers 6, 7, 8 having a plurality of alternate peripheral crests 9 and roots 10 at a pitch equal to that of the thread rollers 3, 4, 5. The groove forming rollers are positioned at an angle $\beta$ to the thread forming rollers when viewed in the projection on a plane normal to the axis of rotation of the body.

The top portions of the thread of the groove-forming rollers 6, 7, 8 are axially displaced relative to the top portions of the thread of the thread rollers 3, 4, 5, if viewed in the projection on a plane normal to the axis of rotation of the body, the amount of said displacement being:

$$(P/2)-(P\beta/360°),$$

where P is a pitch of the thread being rolled.

The thread-rolling tool operates as follows.

When the body 1 is caused to rotate, the thread rollers 6, 7, 8 also start rotating under the action of friction forces applied against the surface of the thread being rolled, and the body starts screwing into the bore. The groove-forming rollers 6, 7, 8 are rolling a helical groove of a pitch being equal to that of the resulting thread. When the thread rollers 3, 4, 5 start functioning, the groove-forming rollers 6, 7, 8 are still within the hole and serve as a tracer to ensure directing the top portions of the profile of the thread rollers 3, 4, 5 between the recesses of the rolled groove. After the thread rollers 3, 4, 5 have passed through the hole, the helical groove is transformed into a cavity having disposed therewithin the profile of the resulting thread.

INDUSTRIAL APPLICABILITY

The above thread-rolling tool may be preferably utilized in the manufacture of metal products for producing nuts of more than 25 mm in diameter by utilizing automatic threaders rather than nut taps.

We claim:

1. A thread-rolling tool comprising:

a unitary cylindrical body having a tail portion for fixing said body in a rotatable spindle;

a plurality of thread rollers uniformly disposed around the circumference of the cylindrical body, the axes of said rollers lying within the circumference of the cylindrical body and being in an angular position relative to the axis of rotation of the body at an angle equal to the lead angle of the helical line of the thread being rolled;

a plurality of groove-forming rollers uniformly disposed around the circumference of the cylindrical body with their axes lying within the circumference of the cylindrical body, the groove forming rollers positioned on the opposite side of the thread rollers from the the tail relative to the axis of the body and including a plurality of alternate peripheral crests and roots having a pitch equal to that of the thread rollers and being disposed in an angular position relative to the axis of rotation of the body and at an angle relative to the thread rollers, the top portions of the groove-forming rollers being axially displaced relative to the top portions of a preceding thread roller, if viewed in the projection on a plane normal to the axis of rotation of the body, the amount of displacement being:

$$(P/2)-P\beta/360°),$$

where

P is a pitch of the thread being rolled, $\beta$ is an angle between the axes of rotation of the groove-forming and preceding thread rollers if viewed in the projection on a plane normal to the axis of rotation of the body.

* * * * *